United States Patent [19]

Jarvis et al.

[11] 4,114,321

[45] Sep. 19, 1978

[54] POOL HAND CLEANING DEVICE HOLDER

[76] Inventors: Clarence W. Jarvis, 6429 Walnut Ave., Orangevale, Calif. 95662; Richard A. Wenrich, 3036 Q St., North Highlands, Calif. 95660

[21] Appl. No.: 819,949

[22] Filed: Jul. 28, 1977

[51] Int. Cl.[2] ..... A46B 17/02; E04H 3/20

[52] U.S. Cl. ..... 51/205 R; 15/1.7; 15/146; 294/34

[58] Field of Search ..... 15/146, 148, 153, 1.7; 51/205 R, 392, 393; 294/34

[56] References Cited

U.S. PATENT DOCUMENTS

| | | | |
|---|---|---|---|
| 1,233,212 | 7/1917 | Flach | 15/146 |
| 1,357,963 | 11/1920 | Delaney | 15/146 X |
| 1,477,685 | 12/1923 | Bostwick | 15/146 |
| 2,769,549 | 11/1956 | Bixby | 15/1.7 |
| 2,816,306 | 12/1957 | Davis | 15/146 X |
| 3,296,643 | 1/1967 | Fortune | 15/1.7 X |
| 3,402,413 | 9/1968 | Gibellina | 15/1.7 |
| 3,858,266 | 1/1975 | Thomas | 15/146 |

FOREIGN PATENT DOCUMENTS

| | | | |
|---|---|---|---|
| 12,454 of | 1910 | United Kingdom | 51/205 R |

*Primary Examiner*—Daniel Blum

[57] ABSTRACT

A pool cleaning device holder is provided with a fixed clamp jaw on one end of a rectangular base which incorporates a slide clamp having thereon a second clamp jaw, said slide clamp being able to slide along guides provided on the inside of the side bars of the rectangular base, whereby said clamp jaws oppose each other at variable distances, and through means provided, can firmly hold various sizes of commercial swimming pool cleaning blocks and devices. Further provided, is a pole handle adapter incorporating an elongated concave adaptor arm, designed to be placed over the outside circumference of any commercial swimming pool service pole of up to one and one-quarter inches in diameter, and attached thereto. Further provided, are attachment flanges on the pole handle adapter that attach to attachment flanges provided on the rectangular base, which allows the rectangular base to be set at various angles to the pole handle adapter and consequently at various angles to the commercial swimming pool service pole to which the invention is attached.

1 Claim, 2 Drawing Figures

POOL HAND CLEANING DEVICE HOLDER

Figure 1:
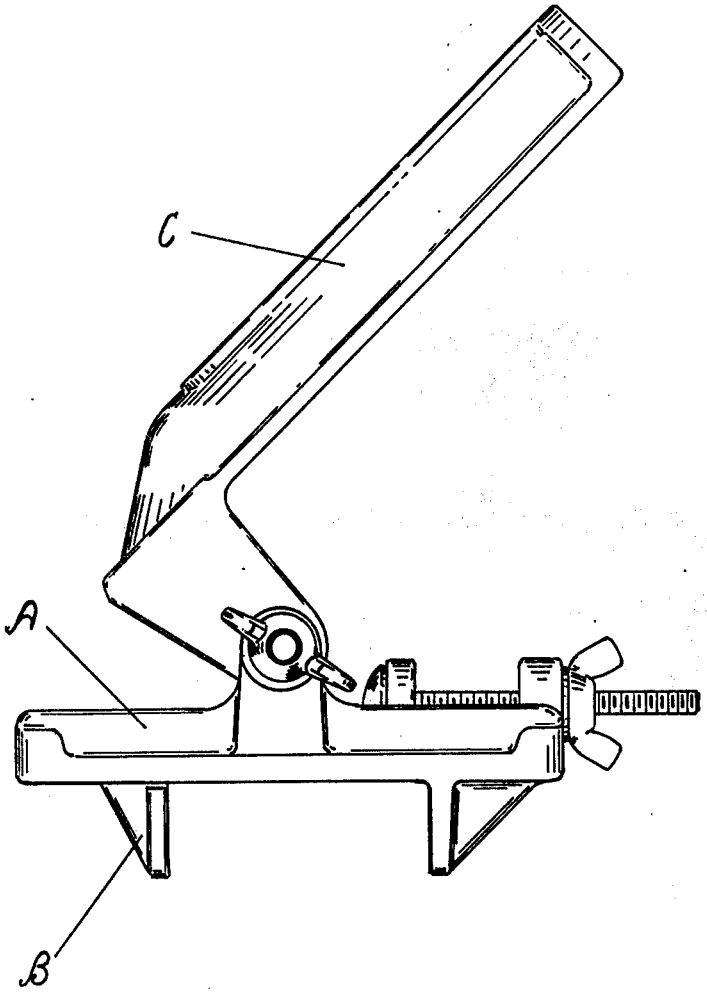

The present invention relates to a swimming pool cleaning device holder which is designed to securely hold various products which are used to clean swimming pool surfaces, whereby when, with a means provided the invention is attached to a standard one and one-quarter inch swimming pool service pole, allows a user to execute the designed function of the pool cleaning product in areas that normally would be beyond the reach of a user who is holding the cleaning product in his hand.

A number of products are now available to swimming pool owners and those that maintain swimming pools, which are designed to remove stains, rust, lime, and algae deposits from the sides and bottom surfaces of swimming pools. These products are made of pumice stone or other abrasive materials, or in some cases are home made devices to which sandpaper or other abrasive materials are attached. These block type devices are then used to rub or scrape the surface areas of the sides and bottom of a swimming pool. The most common usage of these products requires the user to hold the product in his hand and then rub a surface of the product against the swimming pool area to be cleaned. Therefore, to use these products or devices on most of the surface area of the sides and bottom of a swimming pool, the user must either 1) drain all of the water out of the pool, which requires replacement of the water, which replacement may not otherwise by required, at substantial cost in most cases; or 2) enter the swimming pool with the water in it which is impractical much of the time because the temperature of the water is below normal swimming ranges, and at all times further impractical because the user must — in order to reach those areas of the pool which are more than two or three feet under the surface of the water — keep his entire body, including his head, under water during the time that the said products are being used.

Overcoming these difficulties and deleterious affects of the present use of the various swimming pool cleaning devices which have to be held by hand, the present invention is designed to eliminate these troublesome problems by offering a simple-construction, efficient, durable, and practicable device for holding these products at a distance from the user. The invention is provided with an adjustable pole adapter which allows the invention to be attached to any standard one and one-quarter inch swimming pool service pole, which type of service pole is already normally owned by those who own and/or maintain swimming pools. The function of the invention is further aided by this adjustable pole adapter, which allows the surface area of the swimming pool cleaning product being used to be adjusted to various angles, so that the face surface of the swimming pool cleaning product being held will correspond to the pool surface area being cleaned. Furthermore, the invention is provided with a sliding clamp jaw means whereby various sizes of swimming pool cleaning products or devices can be held by the invention and the functional use of the invention is further aided by this sliding clamp jaw means in that the maximum use of such cleaning products or devices, particularly those that wear away with usage, by allowing the pool cleaning product or device to be rotated in the sliding clamp jaw means to take advantage of all of the surface areas of the device and/or allow the cleaning device to continue to be used, through rotation as the surface areas of the cleaning device are depleted.

The principal object of the invention is to provide a means of holding swimming pool cleaning products or devices, normally used by holding the device in the users hand, facilitating the use of said smimming pool cleaning device at some distance from the user.

A further object of the invention is to provide a means of attaching the invention to a standard swimming pool service pole incorporating therein a means of adjusting the angle of the main body of the invention to the attaching means.

A further object of the invention is to provide an adjustable means of holding a swimming pool cleaning product or device so that the various sizes available can be used in the invention, and to provide for the continuous use of the said cleaning devices as they wear away by normal usage, in that the adjustable means provdes the ability to rotate the said product or device within the adjustable holding means, until the greater part of the cleaning product or device has been depleted.

Other objects and advantages of the invention will become better understood hereinafter from a consideration of the specification with reference to the accompanying drawings forming a part thereof, and in which like numerals and letters correspond to like parts throughout the several views of the invention, and wherein:

FIG. 1 is a side view of the invention.

Figure 2:
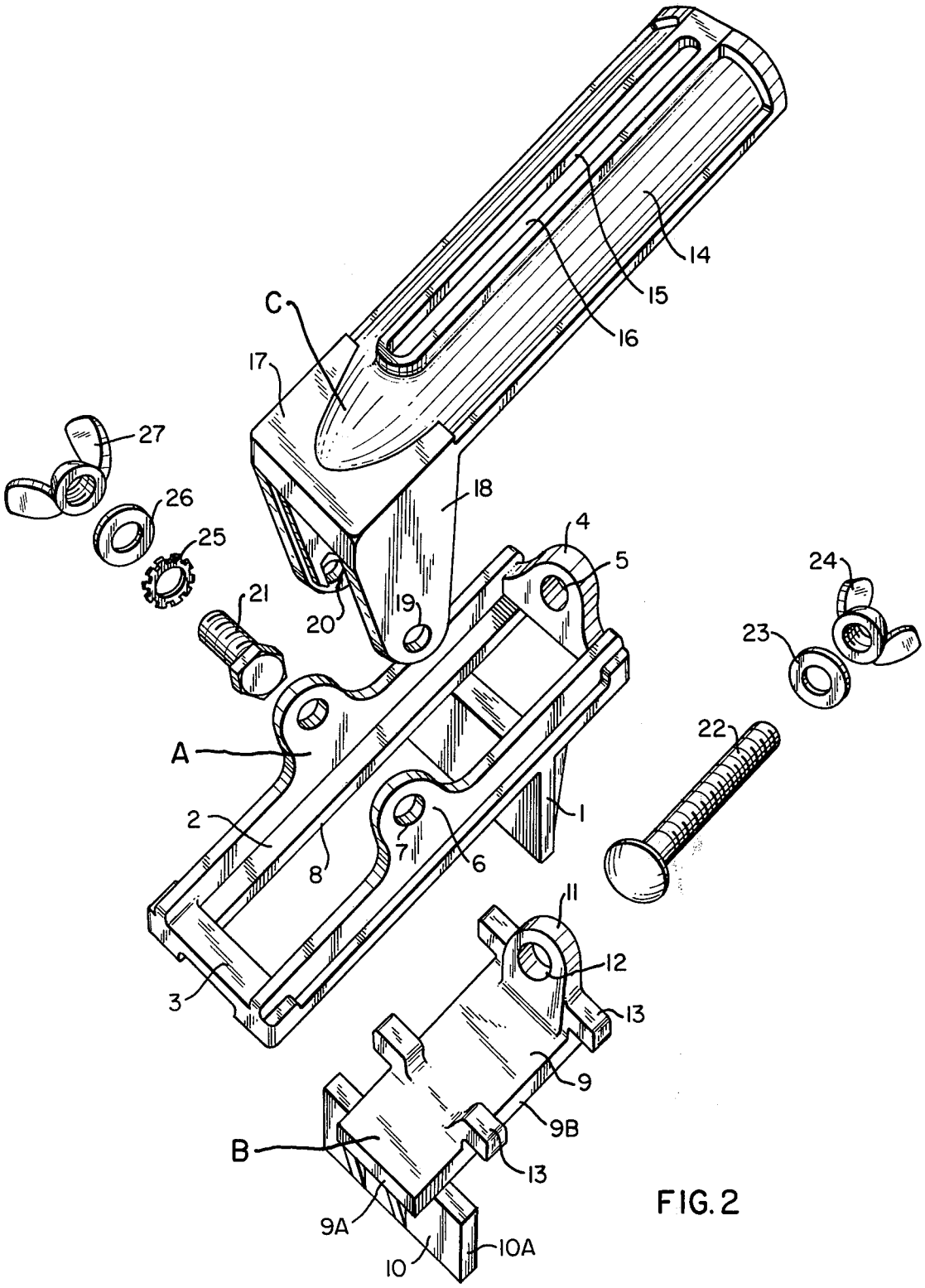

FIG. 2 is a perspective view of the invention with an exploded view of the related parts and which includes a perspective view of the rectangular base indicated as letter A in FIG. 1, a perspective view of the slide clamp indicated as letter B in FIG. 1, with an exploded view of its bolt assembly and a perspective view of the pole adapter indicated as letter C in FIG. 1 with an exploded view of its related hardware.

Referring to the drawings, the pool cleaning device holder characterizing the present invention comprises three components of which the first is a rectangular base, FIGS. 1 and 2, with a stationary clamp jaw 1 protruding downward on the entire width of one end, with the face of said clamp jaw 1 forming a right angle with the side bars 2 of the rectangular base. A rectangular bar 3 forms the other end of the rectangular base whereby, the clamp jaw 1, forming one end of the rectangular base and the rectangular bar 3, forming the other end of the rectangular base, serve to join together the side bars 2, creating in the center of the rectangular base a rectangular space for the insertion of the slide clamp, FIG. 1-B, which will subsequently be further described. A guide flange 4 with a hole 5 drilled in the top center of the said guide flange, protrudes upward at the clamp jaw 1 end of the rectangular base with the sides of said guide flange forming a right angle to the side bars 2, and with the face of the guide flange 4 being parallel to the face of the clamp jaw 1. Attachment flanges 6 with holes 7 drilled in the top center of both flanges, protrude upward from the center of each of the side bars 2, with the faces of the said flanges 6 being parallel to the sides of the side bars 2, and the sides of the attachment flanges 6 being at an angle to the top edge of the said side bars. On the inside of each of the two side bars 2 and forming a part thereof, are guides 8 which continue along the full length of the side bars 2 and form a right angle to the base of the side bars 2.

The second component comprises a slide clamp, FIGS. 1 and 2, being a flat rectangular plate 9 with a clamp jaw 10 protruding downward from end 9A, with the top of said clamp jaw 10 extending beyond the side edge 9B of the rectangular slide plate 9, and with the inside face of the clamp jaw 10A forming a right angle with the bottom surface of the rectangular slide plate 9. A guide flange 11 with a hole 12 in the top center thereof, protrudes upward from the other end (opposite from the clamp jaw end 9A) and with the face thereof forming a right angle with the top surface of the rectangular slide plate 9. Four slide plate lugs 13, protrude outward from the top surface of the rectangular slide plate 9 and extend beyond the side edge 9B of the rectangular slide plate, one each being placed on each side of the guide flange 11 end of the rectangular slide plate, and one each on each side of the center of the rectangular slide plate.

The third component comprises a pole adapter, FIGS. 1 and 2, being an elongated concave pole adapter arm 14 with an inside concave surface 15 designed to be placed on the top portion of a commercial swimming pool service pole of up to one and one-quarter inches in diameter, with a slot 16 extending the length of the pole adapter arm 14 which allows a bolt to be passed through the pole adapter arm 14 into the pool service pole. The pole adapter arm terminates at one end on a flat rectangular plate 17 with attachment flanges 18 protruding downward from the sides of the said rectangular plate 17, said flanges being parallel to each other, with the outer surfaces of the flanges being at a right angle to the top and bottom surfaces of the rectangular plate 17, and the front and back edges of the attachment flanges 18 at a right angle to the edges of the pole adapter arm 14. A hole 19 is drilled in the lower center portion of each flange 18, and on the inside and adjacent to the top half of the hole 19 in each flange 18, a four sided cutout 20 is designed into the wall of the attachment flanges 18 which cutout is designed to prevent the connecting hex head bolt 21 from rotating once the said bolt has been inserted through the hole 19 so that the head of the bolt is flush against the inside surface of the attachment flange 18.

In assembly, the components interact with each other in that the slide clamp, FIG. 1-B, is inserted upward at an angle into the rectangular space formed by the sides 2 and ends 1, 3, and 4 of the rectangular base so that the slide plate lugs 13 are above the rectangular base side bars 2 and the clamp jaw 10 remains below the rectangular base side bars 2. The slide clamp is then twisted and dropped into place so that the sides 9B of the rectangular slide plate 9 are adjacent to the inside edges of the guides 8 which form a part of the rectangular base side bars 2, and in which the top edge of the clamp jaw 10 forming a part of the slide clamp that extends beyond the edges 9B of the rectangular slide plate 9, rest on the bottom side of the side bar guides 8 thereby causing those portions of the slide plate lugs 13 which protrude beyond the edges 9b of the rectangular slide plate 9, to rest on the top surfaces of the side bar guides 8, thus permitting the slide clamp to be moved back and forth along the side bar guides 8. The slide clamp is further held in place by the slide clamp carriage bolt 22 which is inserted through hole 12 in guide flange 11, and continuing through hole 5 in guide flange 4 on the rectangular base, said bolt 22 being secured in place by washer 23 and wing nut 24. The rectangular base and slide clamp assembly is attached to the pole adapter, FIG. 1-C, by inserting the outside surfaces of the attachment flanges 18 adjacent to the inside surfaces of the rectangular base attachment flanges 6, so that the holes 19 in the pole adapter flanges 18, are in line with the holes 7 in the rectangular base attachment flanges 6, with an external tooth washer 25 inserted between the surfaces of the two flanges. Hex head bolts 21 are inserted, from the inside on each side through hole 19 in attachment flanges 18 continuing through the external tooth washers 25 and further through holes 7, in attachment flanges 6, which hex head bolts 21 are then held in place by attaching over and to the ends thereof washers 26 and wing nuts 27.

In operation, a swimming pool clenaing block or other cleaning device is placed between the rectangular base clamp jaw 1, and the clamp jaw 10 on the slide clamp, whereby wing nut 24 on slide clamp bolt 22 is tightened, thereby drawing the slide clamp 9 with its clamp jaw 10, towards the rectangular base clamp jaw 1, until said cleaning device is held firmly in place. The pole adapter arm 14 is then attached to a commercial swimming pool service pole by placing the inside concave area 15 thereof on the service pole at the place provided, and inserting a bolt through holes provided in the service pole, and continuing through the slot 16 on the top of the pole adapter arm and attaching a nut thereto to firmly hold the adapter arm in place on the service pole. The angle of the rectangular base (and thereby the working angle of the surface of the cleaning device being used) to the pole adapter arm 14 is adjusted to the proper position by rotating attachment flanges, 6 and 18, on the axis of the bolts 21 passing through holes 19 and 7 in the said flanges. Once the proper angle of usage has been set, wing nuts 27 are firmly tightened on bolts 21 thus holding, with the aide of the external tooth washers 25, the rectangular base firmly in place at the proper angle of usage. As a result of the adjustable feature incorporated in the clamp jaw 1 and 10, various sizes of pool cleaning products can be used in the invention and because of the adjustable feature in the attachment of the base assembly to the service pole adapter, the surface of the product being used can be used at the proper angle in respect to the sides and bottom of the swimming pool being cleaned.

Having thus described the invention, it is to be understood that certain modifications in the construction and arrangement of the parts thereof will be made, as deemed necessary, without departing from the scope of the appended claim.

We claim:

1. A pool cleaning device holder comprising a combination of a rectangular base means, a slide clamp means, and a pole adapter means wherein the rectangular base means consists of two side bar means with a guide means transversing the length of the inside surfaces, and an end bar means at one end, and a guide flange means at the other end, whereby the side bar means and the end bar and guide flange form a rectangular opening in the center of the rectangular base means serving to receive the slide clamp means, which means is inserted therein, and whereby a clamp jaw means protruded downward from one end of the slide clamp means, with the top surfaces of the ends of the clamp jaw means abutting the bottom surface of the guide means which is incorporated in the side bar means of the rectangular base means, and four lug means protruding outward, two from each side of the top surface of the slide clamp means, whereby said lug means rest on the top surface of the guide means, allowing the slide clamp means to slide back and forth on the guide means and within the said rectangular opening formed by the side bar means and the ends of the rectangular base means, which rectangular base means has incorporated at one end thereof a second and stationary clamp jaw means protruding downward therefrom, said latter means opposing the clamp jaw means protruding downward from the slide clamp means, allowing the combination of the two said clamp jaw means to firmly hold a rectangular object of various sizes between them, a bolt and nut means, for moving the two jaw means towards each other, that runs through two guide flange means, with holes therein, of which one guide flange means protrudes upward from the clamp jaw means end of the rectangular base means, and the other guide flange means protrudes upward on the end of the slide clamp means which is opposite the end containing its clamp jaw means, and where further, the rectangular base means containing the slide clamp means being attached to a pole adapter means through the use of two attachment flange means with holes therein, which means protrude upward from the center of the side bar means of the rectangular base means, and two additional attachment flange means with holes therein protrude downward from a rectangular plate means at one end of the pole adapter means, said combination of attachment flange means being held together through the use of bolt and nut means extended therethrough, whereby the rectangular base means is held firmly in place on the pole adapter means and further, can be set at various angles thereto and held firmly in place at the proper angle for use thereon, and whereby extending outward from the rectangular plate means and forming the remainder of the pole adapter means is an elongated concave holding arm containing a concave inside surface which allows the holding arm, and thereby the pole adapter means, to be attached to a one and one-quarter inch commercial swimming pool service pole, and where said holding arm has therein and transversing the length thereof, a slot which is adapted to receive attachment bolts which are a part of the said commercial swimming pool service pole, whereby the complete assembly of the rectangular base means containing the slide clamp means with both means attached to the pole adapter means, are all able to be firmly held in place on the said commercial swimming pool service pole.

* * * * *